US006439791B1

(12) United States Patent
Takeuchi et al.

(10) Patent No.: US 6,439,791 B1
(45) Date of Patent: Aug. 27, 2002

(54) GRIP AND CAP FOR WRITING TOOL, AND WRITING TOOL

(75) Inventors: Kazuhiro Takeuchi; Mitsuru Kuroda, both of Shizuoka (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 09/232,222

(22) Filed: Jan. 19, 1999

(30) Foreign Application Priority Data

Jan. 19, 1998 (JP) ..... 10-22702

(51) Int. Cl.[7] ..... B43K 29/00

(52) U.S. Cl. ..... 401/195; 401/243; 401/109; 401/6

(58) Field of Search ..... 401/6, 109, 99, 401/243, 117, 98, 195, 52

(56) References Cited

U.S. PATENT DOCUMENTS

| | | | | | |
|---|---|---|---|---|---|
| 1,598,873 | A | * | 9/1926 | Peterson | 401/6 |
| 1,647,536 | A | * | 11/1927 | Miller | 401/6 |
| 1,971,681 | A | * | 8/1934 | Hauton | 401/6 |
| 2,312,069 | A | * | 2/1943 | Baumgartner | 401/98 |
| 4,106,874 | A | * | 8/1978 | Torii | 401/99 |
| 5,102,248 | A | * | 4/1992 | Welschoff | 401/98 |
| 5,174,672 | A | * | 12/1992 | Towsend | 401/6 |
| 5,588,764 | A | * | 12/1996 | Kato | 401/117 |

FOREIGN PATENT DOCUMENTS

| | | |
|---|---|---|
| JP | 48-7122-01 | 6/1971 |
| JP | 58-175979 | 11/1983 |
| JP | 63-66286 | 5/1988 |
| JP | 1-119387 | 8/1989 |
| JP | 3002283 | 7/1994 |

OTHER PUBLICATIONS

"1997 Pilot Catalog Compilation", Pilot Co., Ltd, Jan. 1, 1997.

Japanese Patent Office Action Dated Feb. 21, 2001 With Partial English Translation.

* cited by examiner

*Primary Examiner*—David J. Walczak
(74) *Attorney, Agent, or Firm*—McGinn & Gibb, PLLC

(57) ABSTRACT

A grip is used for a mechanical pencil including a shaft tip portion, a core guide, and a core. This grip is formed into a tube-shape. The grip includes a tip portion, a base portion, and a spacing portion. The tip portion has a tip and a through hole portion and is shaped into a conical-shape so that a diameter thereof is reduced towards the tip. The base portion has a predetermined inner diameter such that the shaft tip portion of the mechanical pencil is treed into the base portion. The spacing portion is formed inside the tip portion and houses the core guide and the core. The core is movable in and out of the tip portion via the through hole portion.

1 Claim, 4 Drawing Sheets

GRIP AND CAP FOR WRITING TOOL, AND WRITING TOOL

BACKGROUND OF THE INVENTION

This invention relates to a grip and a cap for use in a writing tool which are capable of ulilising the writing tool as a touch pen (inputting means) in an electronic device, such as a computer or an electronic notebook, and to a writing tool which is usable as the touch pen.

For instance, an electric device, such as, a computer or an electronic notebook often includes a tablet-type coordinate inputting portion.

In such an electronic device, a user writes a character or draws a figure by the use of a touch pen on a touch panel as the coordinate inputting portion. Thereby, character information or figure Formation is inputted into the electronic device.

However, when the electric device having the coordinate-inputting portion, such as, the touch panel is used by the user, the following problems often takes place.

Namely, when it is necessary that the user writes the character on a document or a writing paper by the use of a mechanical pencil (refillable lead pencil) or a ball-point pen during inputting the character or the figure into the electronic device by the use of the touch pen, the user must manually change the touch pen into the mechanical pencil or the ball-point pen.

Alternatively, when it is necessary that the user inputs the character or the figure into the electronic device by the use of the touch pen during writing the character on the document or the writing paper by the use of the mechanical pencil or the ball point pen, the user must manually change the mechanical pencil or the ball-point pen into touch pen.

Such a changing operation is extremely troublesome for the user.

Further, a specific area for housing or arranging the touch pen must be ensured or kept for a body of equipment of the electronic device itself in the above electronic device. In particular, this becomes a factor for preventing reduction of the electronic device in size and weight in the electronic device of a portable-type, such as, the electronic notebook.

To solve this problem, suggestion has been made about a writing tool ed in Japanese Utility Model No. 3033204 (hereinafter, referred to as a first conventional reference).

In such a first conventional reference, it is difficult to reduce the writing tool in size because a plurality of cores or centers are placed in a shaft tube or a shaft pipe.

On the other hand, another suggestion has been made about a writing tool disclosed in Japanese Unexamined Utility Model No. Sho. 58-175979 (hereinafter, referred to as a second conventional reference).

In such a second conventional reference, a rear end of the writing tool serves as the touch pen. However, the writing tool is disadvantageous in reduction in size because the writing tool becomes inevitably long.

SUMMARY OF THE INVENTION

It is therefore an object of this invention to provide a grip and a cap for a writing tool which are capable of utilizing the writing tool as a touch pen.

It is another object of this invention to provide a writing tool which is usable as a touch pen.

A grip according to this invention is used for a mechanical pencil including a shaft tip portion, a core guide, and a core. This grip is formed into a tube-shape.

The grip includes a tip portion, a base portion, and a spacing portion. In this event, the tip portion has a tip and a through hole portion and is shaped into a conical-shape so that a diameter thereof is reduced towards the tip.

The base portion has a predetermined inner diameter such that the shaft tip portion of the mechanical pencil is forced into the base portion. The spacing portion is formed inside the tip portion and houses the core guide and the core. With such a structure, the core is movable in and out of the tip portion via the through hole portion.

In this case, the mechanical pencil with the grip is used as an inputting means of an electronic device when the core is placed in the spacing portion.

For example, the electronic device is an electronic notebook having a touch panel while the inputting means is a touch pen for inputting a desired information signal.

Under this circumstance, the grip serves as the touch pen when the core is placed in the spacing portion. On the other hand, the mechanical pencil with the grip serves as a normal mechanical pencil itself when the core is placed outside the tip portion via the through hole portion. Herein, the grip is formed by a flexible elastic material, such as, silicon rubber.

Thus, the mechanical pencil with the grip can be utilized as the touch pen in addition to the normal mechanical pencil itself.

In consequence, it is unnecessary that the user alternately changes the mechanical pencil and the touch pen at each time, as the conventional case. This is excessively convenient for the user.

Further, a specific area for housing or placing the touch pen is also unnecessary for the electronic notebook. This is advantageous in reduction of the electronic notebook in size and weight.

Moreover, the grip is fits with the fingers of the user because the grip is formed by the flexible elastic material. Consequently, the mechanical pencil with the grip is also superior in operability.

A cap according to this invention is used for a writing tool which includes a core tip side and a rear end side.

The cap includes a tip and a tip portion. The tip portion has the tip and is shaped into a conical-shape so that a diameter thereof is reduced towards the tip. With such a structure, the cap is attachable to either one of the core tip side and the rear end side of the writing tool.

For instance, the writing tool with the cap is used as an inputting means of an electronic device by the use of the tip portion. The electronic device is an electronic notebook having a touch panel while the inputting means is a touch pen for inputting a desired information signal. Under this circumstance, the cap serves as the touch pen.

On the other hand, the writing tool serves as a normal writing tool itself by removing the cap from the core tip side of the writing tool when the cap is attached to the core tip side.

Herein, it is to be noted that the cap is formed by a flexible resin material.

In this cap, it is unnecessary that the user alternately changes the writing tool and the touch pen at each time, as the conventional case. This is excessively convenient for the user.

Further, a specific area for housing or placing the touch pen is so unnecessary for the electronic notebook. This is advantageous in reduction of the electronic notebook in size and weight.

Moreover, the writing tool does not become long or large in size because only the cap is attached to the writing tool different from the above-mentioned second reference.

A writing tool according to this invention has a core and a shaft tip portion. The shaft tip portion has a tip and is shaped into a conical-shape so that a diameter thereof is reduced towards the tip. The core is movable in and out of the shaft tip portion through the tip. Herein, the shaft tip portion is formed by a flexible resin material.

The writing tool, such as, a ball-point pen or a mechanical pencil, is used as an inputting means of an electronic device when the core is placed in the shaft tip portion.

For instance, the electronic device is an electronic notebook having a touch panel while the inputting means is a touch pen for inputting a desired information signal.

Under this circumstance, the shaft tip portion of the writing tool serves as the touch pen when the core is placed in the shaft tip portion. On the other hand, the writing tool serves as a normal writing tool itself when the core is placed outside the shaft tip portion through the tip.

Thus, the shaft tip portion of the writing tool is formed by the flexible resin material. Consequently, even when the tip of the shaft tip portion is contacted with the touch panel of the electronic notebook, no damage is given to the touch panel. Further, the writing tool can be also used as the touch pen because the shaft tip portion is formed into the conical shape.

Therefore, it is unnecessary that the user alternately changes the writing tool and the touch pen at each time using the writing tool, as the conventional case. This is excessively convenient for the user.

Further, a specific area for housing or placing the touch pen is also unnecessary for the electronic notebook. This is advantageous in reduction of the electronic notebook in size and weight.

Moreover, the writing tool is different from the normal writing tool in only the shaft tip portion. In consequence, the writing tool does not become large and long in size.

DESCRIPTION OF THE PREFERRED EMBODIMENTS (First embodiment)

First, description will be made about a first embodiment of this invention with reference to FIGS. 1 through 3.

Figure 1:
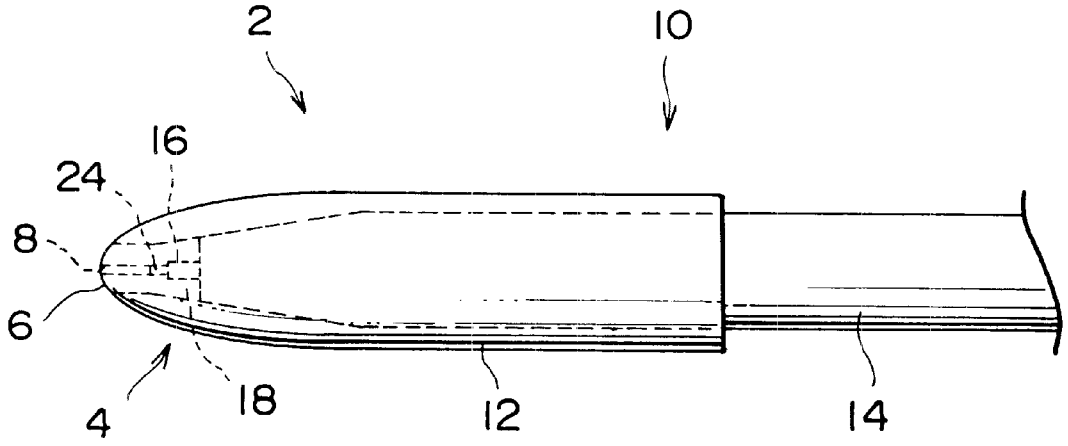
FIG. 1 is a side view showing a grip for a writing tool according to a first embodiment of this invention.

As shown in FIG. 1, a grip 2 for a writing tool is made by forming a flexible elastic material into a tube-shape. A tip portion 4 thereof is formed into a conical-shape so that a diameter thereof is reduced towards a tip 6.

Further, the tip potion 4 has a through hole 8, as illustrated in FIG. 1. Via the through hole 8, a core 24 or a center of a mechanical pencil (or a refillable lead pencil) can move in and out of the mechanical pencil.

Moreover, the grip 2 includes a base portion 10. The base portion 10 has such an internal diameter that a shaft tip portion 12 of the mechanical pencil 14 can be forced or entered therein.

Further, a space portion 18 is formed inside the tip portion 4. A core guide 16 and the core 24 of the mechanical pencil 14 are placed in the space portion.

Herein, it is to be noted that silicon rubber may be used as the above-mentioned flexible elastic material.

In this case, the base portion 10 of the grip 2 has a diameter of about 12 mm, and the through hole portion 8 has the diameter of about 1.5 mm. Further, the core guide 16 has the diameter of about 1.0 mm, and the core 24 has the diameter of about 0.5 mm. Moreover, the space portion 18 has the diameter of about 1.7 mm. However, these dimensions are examples, and this invention is not limited to these values.

Figure 4:
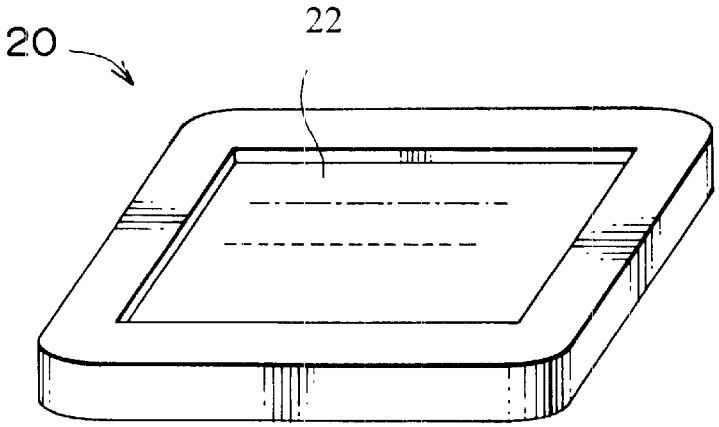
FIG. 4 is a perspective view showing an example of an electronic notebook having a touch panel.

For example, the grip 2 can be used for an electronic notebook 20 illustrated in FIG. 4. In this event, the electronic notebook 20 includes a touch panel 22 of a pressure-sensitive type.

With such a structure, a user writes a character or draws a figure with suitable writing pressure on the touch panel 22 by the use of the touch pen. Thereby, character information or figure information is inputted into the electronic notebook 20.

When the grip 2 is used by the user, the shaft tip portion 12 of the mechanical pencil 14 is forced or entered inside the grip 2 through the base portion of the grip 2. Thereby, the grip 2 is attached to the mechanical pencil 14.

Figure 2:
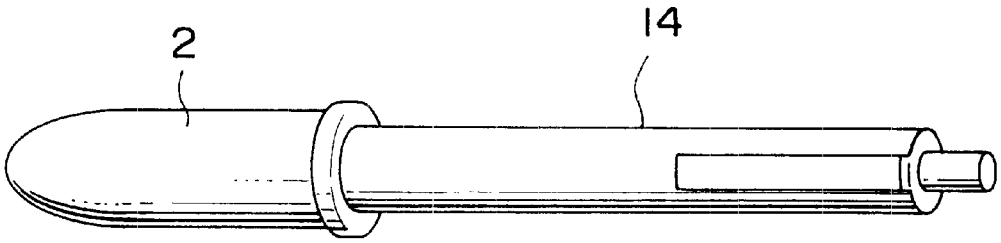
FIG. 2 is a perspective view showing a mechanical pencil with a grip according to a first embodiment of this invention.

In this case, it is assumed that the core 24 of the mechanical pencil 14 is placed in the space portion 18, as illustrated in FIG. 2.

In this condition, even when the tip 6 of the grip 2 is directly contacted with the touch panel 22 illustrated in FIG. 4, the touch panel 22 is not damaged because the grip 2 is formed by the flexible elastic material.

Further, the tip portion 4 is formed into the conical shape, as mentioned before. Consequently, the mechanical pencil 14 with the grip 2 can be used as the touch pen.

As a result, the character information or the figure information can be inputted by writing the character or drawing the figure on the touch panel 22 illustrated in FIG. 4 by the use of the mechanical pencil 14 which serves as the touch pen.

Figure 3:
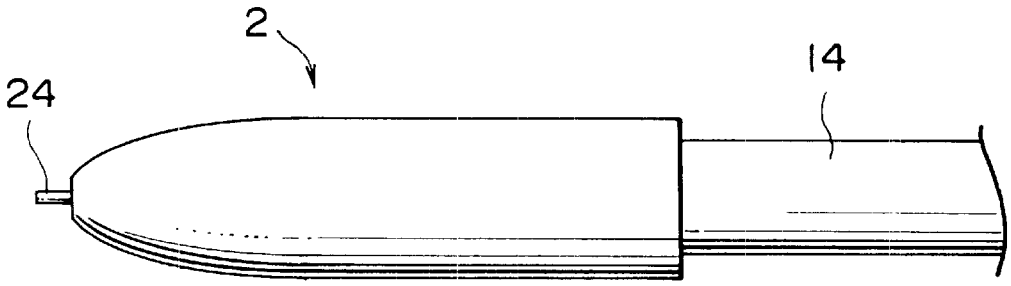
FIG. 3 is a side view showing a grip in such a state that a core is extended from a mechanical pencil according to a first embodiment of this invention.

On the other hand, when the core 24 of the mechanical pencil 14 is extended from the tip 6 of the grip 2 via the through hole portion 8 with proper quantity, as illustrated in FIG. 3, the mechanical pencil 14 with the grip 2 serves as the mechanical pencil itself on the condition that the grip 2 is attached to the mechanical pencil 14.

Namely, the mechanical pencil 14 with the grip 2 can be utilized as the touch pen for the touch panel 22 in addition to the normal mechanical pencil itself. In consequence, it is unnecessary that the user alternately changes the mechanical pencil and the touch pen at each time, as the conventional case. This is excessively convenient or the user.

Further, a specific area for housing or placing the touch pen is also unnecessary for the electronic notebook 20, as illustrated in FIG. 4. This is advantageous in reduction of the electronic notebook 20 in size and weight.

Moreover, the grip 2 fits with the fingers of the user because the grip 2 is formed by the flexible elastic material. Consequently, the mechanical pencil 14 with the grip 2 is also superior in operability.

(Second embodiment)

Subsequently, description will be made about a second embodiment of this invention with reference to FIG. 5.

Figure 5:
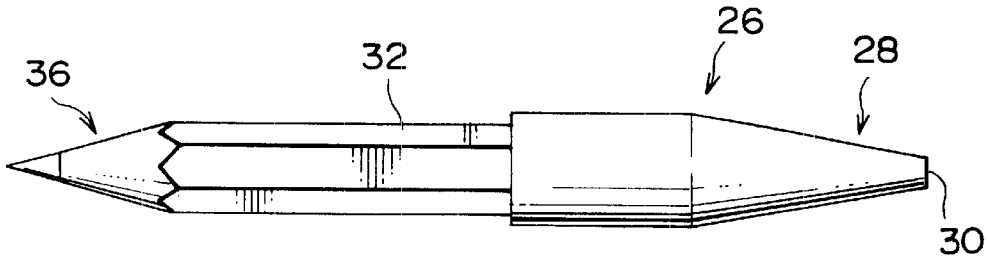
FIG. 5 is a side view showing a cap with a writing tool according to a second embodiment of this invention.

In the second embodiment, a cap 26 for a writing tool, such as, a pencil 32 is attached to a rear side thereof, as illustrated in FIG. 5. In this event, the writing tool may include a ball-point pen or so-called a sign pen and like.

Alternatively, the cap 26 may be attached to a core tip side (pen tip aide) of the pencil 32. Herein, it is to be noted that the cap 26 is formed by a flexible resin material. For example, thermal plastic elastomer may be used as the above-mentioned flexible resin material.

As illustrated in FIG. 5, a tip portion 28 of the cap 26 is formed into a conical-shape so that a diameter thereof is reduced towards a tip 30.

In this case, it is assumed that the cap 30 is attached to the rear portion of the pencil 32, as illustrated in FIG. 5. In this condition, even when the tip 30 of the cap 26 is directly contacted with the touch panel 22 illustrated in FIG. 4, the touch panel 22 is not damaged.

Thus, the pencil with the cap 26 can be used as the touch pen for the touch panel 22 illustrated in FIG. 4 because the tip portion 28 is formed into the conical shape, as mentioned above.

On the other hand, when the pencil 32 with the cap 26 is used as the pencil 32 itself for writing, a core tip 36 of the pencil 32 is used instead of the tip 30 of the cap 26 by reversing the direction of the pencil 32.

Alternatively, the cap 26 may be attached to the core tip 36 side, as mentioned before. In this event, the pencil 32 with the cap 26 can be used as the touch pen in such a state. When the pencil 32 with the cap 26 is used as the pencil 32 itself for writing, the cap 26 must be removed from the core tip 36 of the pencil 32.

Therefore, it is unnecessary that the user alternately changes the pencil 32 and the touch pen at each time, as the conventional case. This is excessively convenient for the user.

Further, a specific area for placing the touch pen is also unnecessary for the electronic notebook 20, as illustrated in FIG. 4. This is advantageous in reduction of the electronic notebook 20 in size and weight.

Moreover, the writing tool does not become long or large in size because only the cap 26 is attached to the pencil 32.

In this embodiment, although the cap 26 is attached to the pencil 32, the writing tool ,which is attached the cap 26, is not limited to the pencil 32, and the cap 26 may be attached to the ball-point pen or the so-called sign pen to achieve the same effect, as mentioned above.

Figure 6A:
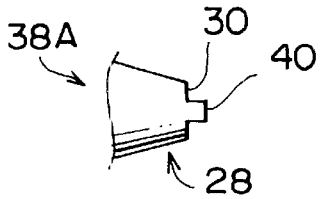
FIGS. 6A and 6B are pail enlarged side views showing other embodiments of caps according to a second embodiment of this invention.
Figure 6B:
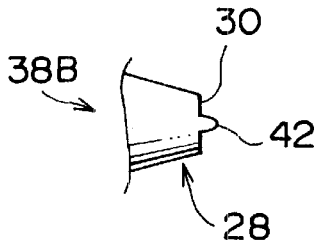

Further, projection 40 or 42 may be formed at the tip 30 of the cap 30, as illustrated in FIGS. 6A and 6B. With these structures, each of the projections 40 and 42 is directly contacted with the touch panel 22 illustrated in FIG. 4. Thereby, touch positions can be precisely designated on the touch panel 22. As a result, character information or figure information can be accurately inputted through each of the projections 40 and 42.

(Third embodiment)

Subsequently, description will be made about a third embodiment of this invention with reference to FIGS. 7 and 8.

Figure 7:
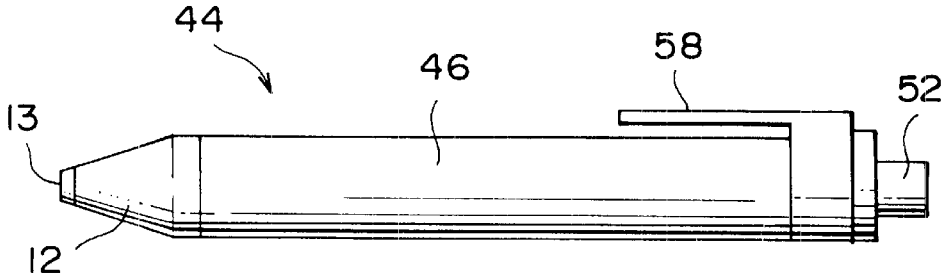
FIG. 7 is a side view showing a ball-point pen according to a third embodiment of this invention.

A ball-point pen 44 illustrated in FIG. 7 is of a knock-type. As illustrated in FIG. 8, a core 48 of the ball-point pen 44 is placed inside a shaft tube main body 46. Further, the ball-point pen 44 includes a feeding mechanism of the core 48. This feeding mechanism is composed of a coil spring 50, in which the core 48 is placed, a knock button 52, and a stopper mechanism (not shown) in the shaft tube main body 46.

A shaft tip portion 12 is formed by a flexible resin material. Further, the shaft tip portion 12 is formed into a conical-shape so that a diameter thereof is reduced towards the tip 13, and has a male screw portion 66 at a base portion 54 side. The cap 12 includes an opening therein for allowing the core 48 to pass therethrough.

With this structure, the shaft tip portion 12 is attached to the shaft tube main body 46 by screwing the male screw portion 56 with a female screw portion (not shown) formed at a shaft tip portion of the shaft tube main body 46. Thus, the ball-point pen illustrated in FIG. 7 is completed.

Further, a clip 58 is attached near an end portion of the shaft tube main body 46 at the opposite side against the shaft tip portion 12. Herein, it is to be noted that thermal plastic elastomer may be used as the above-mentioned flexible resin material.

As mentioned before, the shaft tip portion 12 of the ball-point pen 44 is formed by the flexible resin material. Consequently, even when the tip 13 of the shaft tip portion 12 is directly contacted with the touch panel 22 illustrated in FIG. 4, no damage is given to the touch panel 22.

Thus, the ball-point pen 44 can be used as the touch pen because the shaft tip portion 12 is formed into the conical shape.

Therefore, it is unnecessary that the user alternately changes the ball-point pen and the touch pen at each time using the boll-point pen 44, as the conventional case. This is excessively convenient for the user.

Further, a specific area for placing the touch pen is also unnecessary for the electronic notebook 20 illustrated in FIG. 4. This is advantageous in reduction of the electronic notebook 20 in size and weight.

Figure 8:
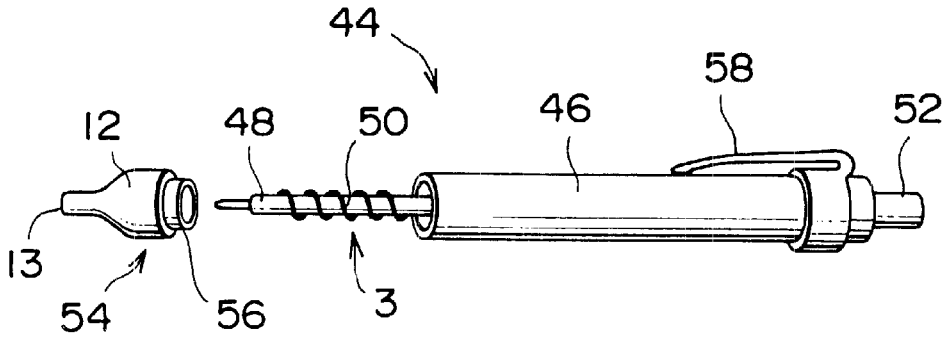
FIG. 8 is an exploded perspective view showing a ball-point pen according to a third embodiment of this invention.

Moreover, the ball-point pen 44 illustrated in FIGS. 7 and 8 are different from the normal ball-point pen in only the shaft tip portion 12. In consequence, the ball-point pen 44 does not become large or long in size.

(Fourth embodiment)

Subsequently, description will be made about a fourth embodiment of this invention with reference to FIGS. 9 and 10.

Figure 9:
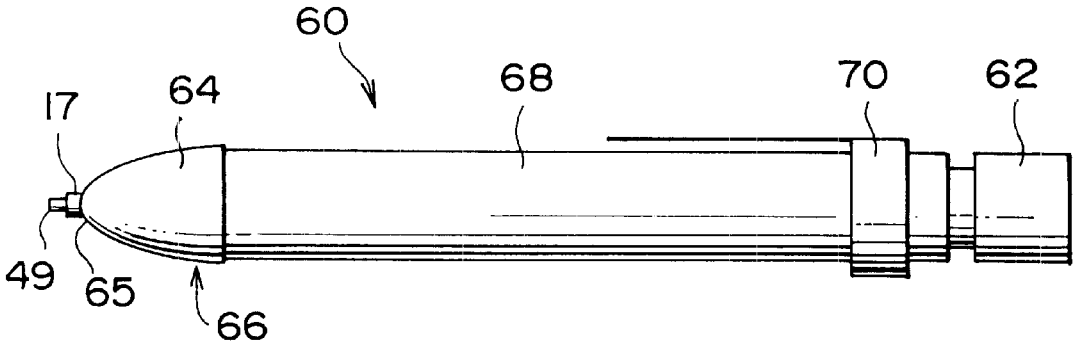
FIG. 9 is a side view showing a mechanical pencil according to a fourth embodiment of this invention.
Figure 10:
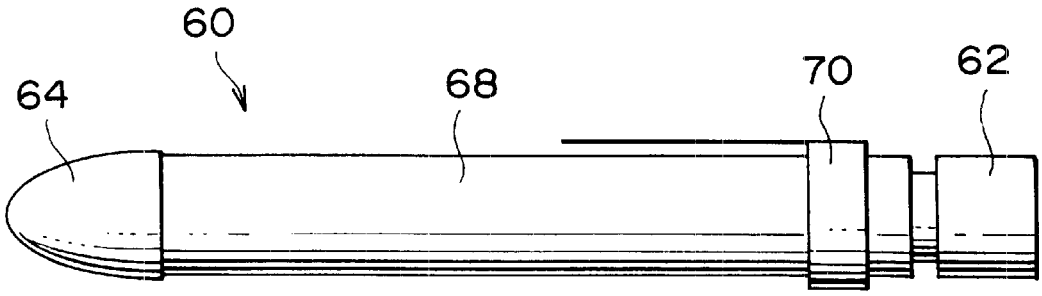
FIG. 10 is a side view showing a mechanical pencil in a state that a core and a core guide are placed therein according to a fourth embodiment of this invention.

A mechanical pencil 60 (or a refillable lead pencil) illustrated in FIGS. 9 and 10 is of a core guide housing-type. A core 49 and a core guide 17 can be placed in a shaft tip portion 64 by an operation of a knock button 62.

The shaft tip potion 64 is formed by a flexible resin material. Further, the shaft tip portion 64 is formed into a conical-shape so that a diameter thereof is reduced towards a tip 66. The shaft tip portion 64 has a male screw (not shown) at the base portion 66 side, like the shaft tip portion 12 of the above-mentioned ball-pint pen 44 illustrated in FIG. 8.

With this structure, the shaft tip portion 64 is attached to the shaft tube main body 68 by screwing the male screw portion with a female screw portion (not shown) formed at a shaft tip portion of the shaft tube main body 68.

Further, a clip 70 is attached near an end portion of the shaft tube main body 68 at the opposite side against the shaft tip portion 64.

As mentioned before, the shaft tip portion 64 of the mechanical pencil 60 is formed by the flexible resin material.

Consequently, even when the tip 65 of the shaft tip portion 64 is directly contacted with the touch panel 22 illustrated in FIG. 4, if the core 49 and the core guide 17 are place inside the shaft tip portion 64 as shown in FIG. 10, no damage is given to the touch panel 22.

Further, the mechanical pencil 60 can be used as the touch pen because the shaft tip portion 64 is formed into the conical shape.

Therefore, it is unnecessary that the user alternately changes the mechanical pencil and the touch pen at each time using the mechanical pencil 60, as the conventional case. This is excessively convenient for the user.

Further, a specific area for placing the touch pen is also unnecessary for the electronic notebook 20 illustrated in FIG. 4. This is advantageous in reduction of the electronic notebook 20 in size and weight.

Moreover, the mechanical pencil 60 illustrated in FIGS. 9 and 10 is different from the normal mechanical pencil in only the shaft tip portion 64. In consequence, the mechanical pencil 60 does not become large and long in size.

What is claimed is:

1. A grip which is made of a flexible elastic material formed into a tube-shape, for use with a mechanical pencil having a core guide, a core and a shaft tip portion which is held by a user during use, comprising:

a tip portion which is shaped into a conical-shape so that a diameter thereof is reduced toward a tip;

a space portion in said tip portion in which the core guide and core can be housed;

a through hole portion which is formed in the tip portion such that the core of the pencil is movable in and out of the tip portion and sized such that the shaft tip portion cannot pass therethrough; and a base portion, said base portion comprising an inner diameter adapted to accomodate the shaft tip portion of the pencil whereby the shaft tip portion is forcible into the base portion, whereby when the grip is positioned over the mechanical pencil and an end of the core is retracted into said space portion, said tip portion is adapted to be used to input information into an electronic device by contacting a pressure sensitive surface thereon and when the end of the core protrudes through said through hole portion, the mechanical pencil can be conventionally used to write on a writing surface.

* * * * *